US005579903A

United States Patent [19]

McEvilly et al.

[11] Patent Number: 5,579,903

[45] Date of Patent: Dec. 3, 1996

[54] CAM FOLLOWER ASSEMBLY FOR USE IN A LATCHING SWITCH

[75] Inventors: Paul McEvilly, Redford, Mich.; Janet M. Cochran, Las Vegas, Nev.; David A. Coffin, Novi; Thomas J. Allard, Walled Lake, both of Mich.

[73] Assignee: United Technologies Automotive, Inc., Dearborn, Mich.

[21] Appl. No.: 398,972

[22] Filed: Mar. 6, 1995

[51] Int. Cl.[6] ..... H01H 3/42

[52] U.S. Cl. ..... 200/524; 200/523; 200/520

[58] Field of Search ..... 200/524, 523, 200/520, 521, 528, 529, 533, 318.1, 323; 74/567, 568 FS, 569

[56] References Cited

U.S. PATENT DOCUMENTS

| | | | |
|---|---|---|---|
| 3,707,610 | 12/1972 | Davies | 200/524 |
| 3,766,346 | 10/1973 | Alexander | 200/524 |
| 4,531,032 | 7/1985 | Murata | 200/524 |
| 4,762,967 | 8/1988 | Burdick | 200/528 |
| 4,769,518 | 9/1988 | Burdick | 200/528 |
| 5,369,237 | 11/1994 | Mejerl et al. | 200/524 |

FOREIGN PATENT DOCUMENTS

| | | | |
|---|---|---|---|
| 2715063 | 11/1977 | Germany | 200/524 |

*Primary Examiner*—David J. Walczak
*Attorney, Agent, or Firm*—Howard & Howard

[57] ABSTRACT

A cam follower assembly for use in a latching switch assembly comprises a case having opposed walls with a slot in one of the walls. A cam follower disposed in the case has a post movable within the slot. A spring adjacent the cam follower biases the cam follower toward a longitudinal axis of the case. The cam follower assembly cooperates with a cam in the latching switch assembly to operate an electrical switch. In a preferred embodiment, the cam follower assembly moves in a plane parallel to the plane of the cam surface. When an operator depresses the latching switching in the latching switch assembly, the cam follower rides along the cam to an "on" position where the latching switch is held in place. Upon depressing the latching switch once more, the cam follower moves out of the first position and into its original "off" position. The slot guides the cam follower for proper desired movement. The spring is preferably a C-shaped spring with two arms positioned on each side of the cam follower. The use of the spring and slot combination reduces the necessity of precise positioning and manufacture of either the spring or the cam follower. Moreover, bending of the spring during operation of the switch will not be a problem, as it may have been in the prior art.

21 Claims, 2 Drawing Sheets

Fig-3
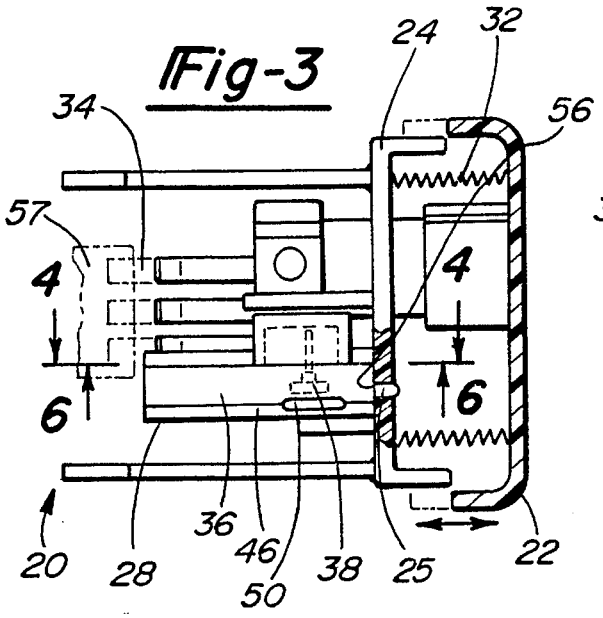
Fig-4
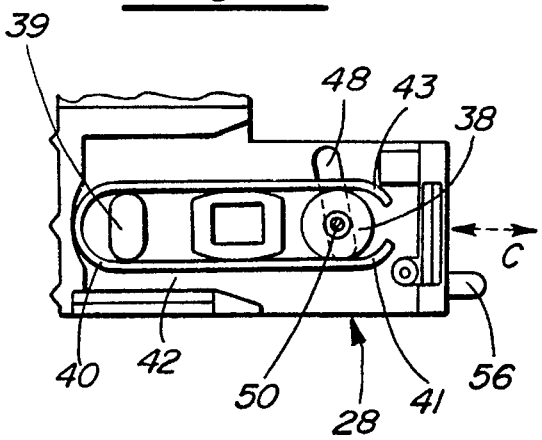
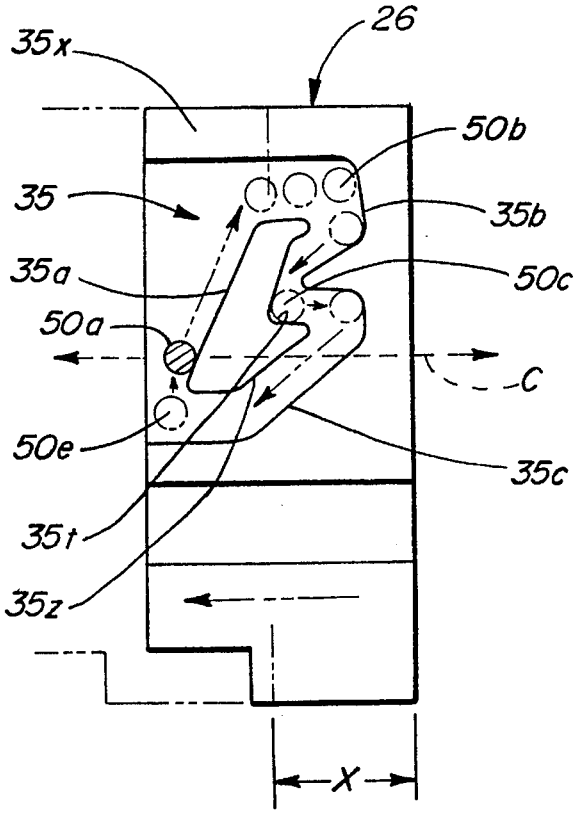
Fig-6

CAM FOLLOWER ASSEMBLY FOR USE IN A LATCHING SWITCH

BACKGROUND OF THE INVENTION

The present invention is directed generally to electrical switches and, more specifically, to a cam follower assembly for use in push-push type latching switch assemblies.

Push-push type latching switches which control actuation of an electrical function are well known in the automotive industry. In general, push-push type latching switches could be described as switches in which the switch is normally biased to an "off" position. The switch may be pushed inwardly, and is then returned slightly rearwardly to an "on" position. The switch remains at rest in this "on" position. When one desires to turn the switch back to the "off" position the switch is again pressed inwardly, and at that time the switch returns fully to the "off" position. Various methods of achieving this movement have been utilized in the prior art.

In one recent latching assembly for latching the switch at the "on" position and allowing it to be released back to the "off" position upon release, a cam follower rides along a heart-shaped cam surface located in a latching switch assembly. The cam follower begins movement along a first face of the cam surface as the switch moves from the "off" position inwardly on a first depression of the switch. Once the switch is fully depressed, the cam follower is at the end of that first surface of the cam surface. A spring bias force then forces the cam follower into a trough, where it is retained. The cam follower secures the cam surface, and thus the switch button at this position spaced inwardly from the "off" position. This is the "on" position. In the "on" position electrical contacts associated with the switch are in a position on a circuit board where an electrical circuit is made and a vehicle function is actuated. When one desires to move the switch back to the "off" position, the switch is again depressed inwardly. The cam follower moves out of the trough and begins movement along a second surface. Eventually, the cam follower returns to its initial position.

In such prior art assemblies, the cam follower must be spring biased to a particular position relative to the housing which receives the cam follower. In the prior art, the cam follower has typically been a finger at the end of a torsion spring. The torsion spring has been mounted in the housing, and the cam follower has performed its movement along the cam surface. The torsion spring biases the cam follower as is required. However, with this type of prior art system, precise positioning and manufacture of the cam follower are required. With any variation in the mounting, positioning or manufacture of the torsion spring and cam follower, the movement of the cam follower along the cam surface will be as required for operation of the switch.

The above-described limitations in such push-push type latching switches have, heretofore, not been addressed. The invention herein solves the above-identified limitations and provides a superior latching switch assembly.

SUMMARY OF THE INVENTION

In a disclosed embodiment of the invention, a cam follower assembly for use in a latching switch assembly comprises a case having at least one wall with a slot in the wall. A cam follower is disposed in the case and has a shaft movable within the slot. A spring disposed in the case adjacent the cam follower biases the cam follower toward a longitudinal axis of the case.

The present invention improves upon the prior art cam followers by utilizing the slot to guide movement of the cam follower. In addition, a C-shaped spring having two arms surrounds the cam follower. The two arms bias the cam follower back towards an axis of the housing at which it is desired for the cam follower to rest in a relaxed position. Since the C-shaped spring may be easily positioned within the housing, precise positioning of the cam follower or spring is not required. Moreover, slight manufacturing differences in the spring or cam follower do not affect the operation of the overall system. Also, the slot limits movement of the cam follower relative to the spring along an axial direction. Without the slot, the cam follower would be free to move axially between the two legs of the C-shaped spring.

In a further feature of this invention, the housing which receives the cam follower and the spring is an enclosed housing formed by two opposed walls connected by a living hinge. The living hinge housing is easily and quickly assembled by snapping an attachment element on one of the walls into a channel in the other of the two walls.

These and other features of the present invention will be best understood from the following specifications and drawings, of which the following is a brief description.

BRIEF DESCRIPTION OF THE DRAWINGS

FIG. 3 is a partially sectional elevation view of the latching switch assembly of FIG. 1;

FIG. 4 is a cross-sectional view of the cam follower assembly of FIG. 3 along line 4—4;

FIG. 6 is a cross-sectional view of the cam surface of FIG. 3 along line 6—6.

DETAILED DESCRIPTION OF A PREFERRED EMBODIMENT OF THE INVENTION

Figure 1:
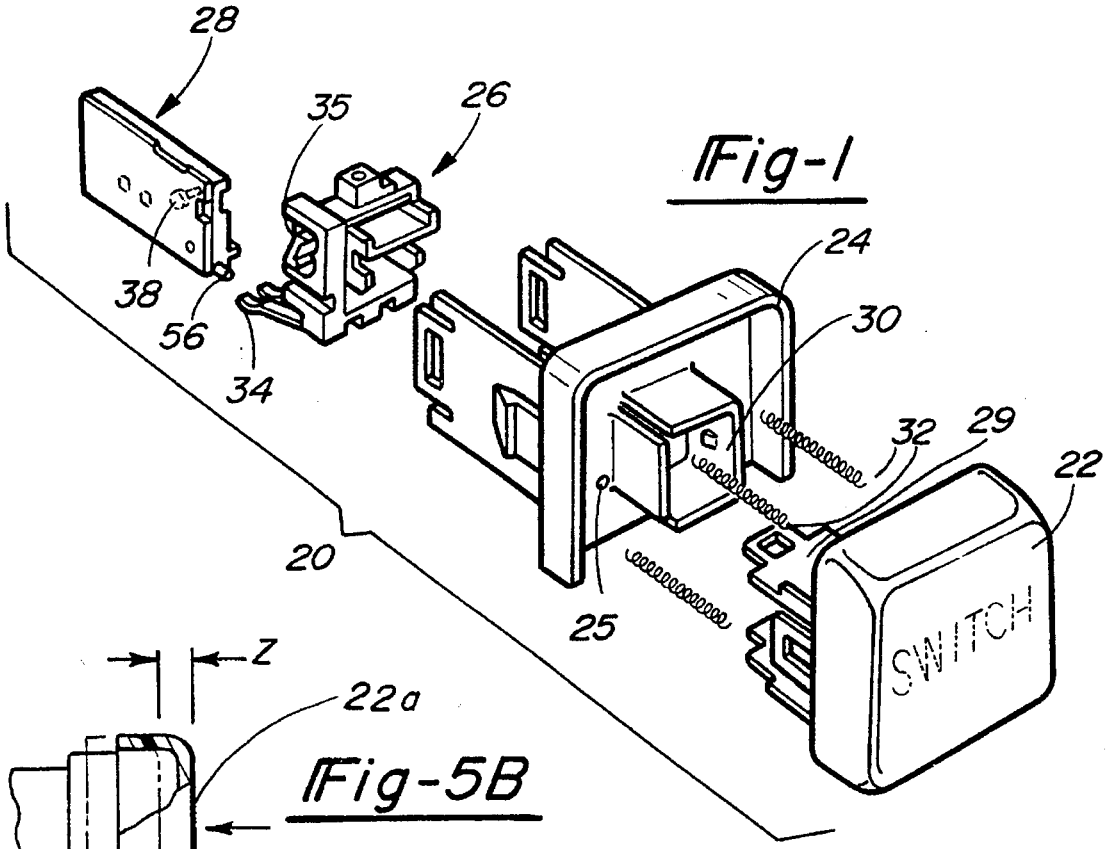
FIG. 1 is an exploded, perspective view of a latching switch assembly including a cam follower assembly in accordance with the invention herein.

A latching switch assembly 20 includes a latching switch button 22, a latching switch body 24, a cam assembly 26 and cam follower assembly 28. Switch button 22 has legs 29 received in channel 30 of latching switch body 24, with springs 32 biasing switch button 22 away from latching switch body 24. This invention relates to innovations in cam follower assembly 28. Even so, the remainder of one switch embodiment will be described in detail to provide an explanation of the function of the cam follower assembly 28. It should be understood that this invention extends to other switch types, and that the specifically disclosed switch is not limiting on the invention.

Cam assembly 26 includes electrical connection arms 34 which contact circuit elements on a circuit board (not shown in this figure). Cam assembly 26 is fixed to move with button 22. By depressing switch button 22, cam assembly 26 is moved, thereby sliding electrical connection arms 34 across circuit elements of a circuit board to control an electrical function. Cam follower 38 of cam assembly 28 cooperates with a cam surface 35 of cam assembly 26 to lock cam assembly at "on" and "off" positions and locate electrical connection arms 34 along the circuit board, as will be described below.

Figure 2:
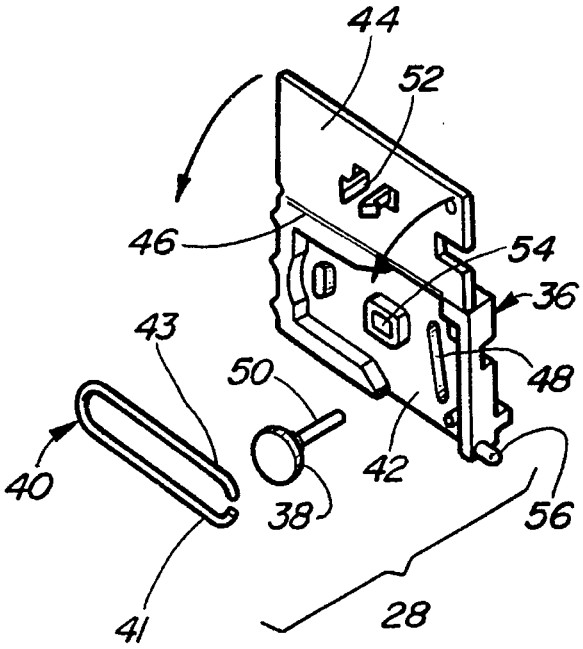
FIG. 2 is an exploded, perspective view of the cam follower assembly of FIG. 1.

As shown in FIG. 2, cam follower assembly 28 includes a case 36, a cam follower 38 and a symmetric, C-shaped cam spring 40. Case 36 includes opposed walls 42 and 44 connected by a living hinge 46. Case 36 is preferably made of known thermosetting plastic material, with living hinge 46 and walls 42 and 44 integrally forming a housing. First wall 42 includes a slot 48 which receives and guides shaft 50 of cam follower 38. For ease of assembly, second wall 44 includes attachment elements 52 which are received in channel 54 formed in first wall 42. When assembled, cam follower 38 and cam spring 40 are received within case 36. Shaft 50 is received in slot 48 and spring arms 41 and 43 of cam spring 40 are disposed on either side cam follower 38. Case 36 is bent at living hinge 46, with attachment elements snapped into channel 54 enclosing the housing of cam follower assembly 38. Shaft 50 extends through slot 48, and beyond wall 42.

As shown in FIG. 3, post 56 of cam follower assembly 28 is received in aperture 25, fixing the cam follower assembly to latching switch body 24. Shaft 50 of cam follower 38 is received in a channel formed by cam surface 35 of cam body 26. Circuit board 57 is shown schematically in this figure. When mounted in a vehicle some structure may be positioned rearwardly of cam follower assembly 28 holding it against switch body 24. An outer surface of first wall 42 is positioned adjacent an end surface 35*x* of cam assembly 26. Shaft 50 moves in a plane parallel to the plane of cam surface 35*x* in a two dimensional fashion. As will be explained, successive depressions of switch button 22 actuates cam body 26 which moves electrical connection arms 34 along circuit board 57, thereby controlling an electrical switch. Case 36 of cam follower assembly 28 does not move with switch button 22 or cam assembly 26, but remains static with latching switch body 24.

As shown in FIG. 4, cam spring 40 and cam follower 38 are received in case 36 with shaft 50 of cam follower 38 received in slot 48 and arms 41 and 43 of cam spring 40 adjacent cam follower 38. Spring 40 lies in a plane perpendicular to post 50 of cam follower 38. Spring 40 lies in a plane perpendicular to post 50 of cam follower 38. Spring 40 is simply snapped over post 39. Thus, it is relatively easy to ensure proper placement of the spring 40, due to post 39. Arms 41 and 43 bias cam follower 38 back toward longitudinal axis C should cam follower 38 move away from axis C. With movement in one direction, arm 43 of spring 40 biases cam follower 38 toward axis C. With movement in the other direction, arm 41 of spring 40 biases cam follower 38 toward axis C. As shown, slot 48 will allow movement of shaft 50 to either lateral side of axis C. In practice, post 50 would extend from the plane of the paper of this figure, but is shown in the figure for clarity. Post 50 of cam follower 38 cooperates with cam surface 35 in a manner which displaces post 50 from longitudinal axis C, as will be described below. The arms 41 and 43 bias the cam follower 38 back toward axis C.

Figure 5B:
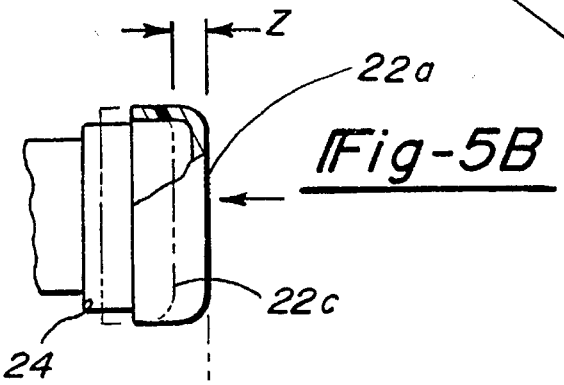
FIGS. 5A and 5B are side elevational views of the latching switch button of FIG. 3.
Figure 5A:
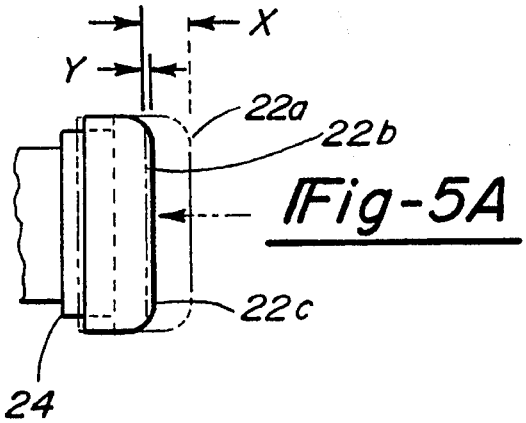

As shown in FIG. 5A, when an operator depresses switch button 22 from an initial "off" position 22*a* (shown in phantom), a switch button 22 is displaced a lateral distance X to a first position 22*b* (also shown in phantom). In position 22*a*, the electrical connection arms 34 are not in a position on circuit board 57 to actuate the controlled function. Upon releasing the switch button 22, springs 32 bias switch button 22 away from latching switch body 24, thereby displacing switch button 22 a distance Y from first position 22*b* to second position 22*c*. At position 22*c*, push button 22 remains in an "on" position, which is a distance Z from the initial "off" position 22*a* (see FIG. 5B). In position 22*c*, the electrical connection arms 34 are in a position on circuit board 57 to actuate some function. As will be explained, the cam follower 38 locks the switch at position 22*c*.

A second depression of switch button 22 displaces switch button 22 a distance Y from second position 22*c* back to first position 22*b*. Upon releasing the button from position 22*b*, springs 32 bias switch button 22 away from latching switch body 24 back to initial position 22*a*. As shown in FIG. 5B, between the "on" and "off" positions, the switch button 22 is displaced a net distance Z.

How the push button 22 is locked at the "on" and "off" positions will now be described in FIG. 6. Shaft 50 of cam follower 38 moves along cam surface 35 as cam body 26 is actuated with successive depressions of switch button 22, as described above. When switch button 22 is at its initial "off" position 22*a*, cam follower shaft 50 starts at position 50*a* in line with longitudinal axis C. As switch button 22 is depressed toward position 22*b*, cam shaft 50 rides along a first face 35*a* of cam surface 35 to position 50*b*. Slot 48 guides shaft 50 during this movement. Cam shaft 50 is displaced from longitudinal axis C at position 50*b*, and arm 43 of cam spring 40 thus biases cam follower 38 back toward longitudinal axis C. Upon releasing switch button 22, this bias force drives cam shaft 50 along a second face 35*b* of cam surface 35 to position 50*c*. This position corresponds to "on" position 22*c* of switch button 22 in FIG. 5A. At position 50*c*, arm 43 of cam spring 40 continues to bias cam follower 38 and shaft 50 toward longitudinal axis C, but a trough 35*t* formed by cam surface 35 maintains shaft 50 in the "on" position 50*c*. A second depression of switch button 22 displaces shaft 50 from position 50*c* to position 50*d*, corresponding to the position 22*b* of switch button 22 after movement out of position 22*c*. Upon release of switch button 22, shaft 50 is driven along face 35*c* of cam surface 35. As shaft 50 rides along face 35*c*, it passes through longitudinal axis C. After passing axis C, the cam follower is driven along face 35*z*, as cam assembly 26 is still to be returned to the right as shown in this figure, and back with switch button 22 to position 22*a*. After the crossing of axis C, arm 41 of cam spring 40 biases cam follower 38 and shaft 50 back toward longitudinal axis C. Once reaching position 50*e*, this bias force returns cam follower 38 to position 50*a*. Throughout this entire movement, slot 48 guides shaft 50. Thus, cam follower spring 40 is able to bias cam follower 38 and shaft 50 toward a longitudinal axis C in both lateral directions.

Slot 48 is preferably between an angle of 0° to about 30°, as measured from an axis perpendicular to the longitudinal axis C. In one preferred embodiment, the slot is at an angle of about 10°. Slot 48 guides movement of shaft 50 of cam follower 38 as it moves along cam surface 35. Slot 48 also limits movement of cam follower 38 relative to spring 40 by preventing cam follower 38 from moving axially between legs 41 and 43 through the housing of cam follower assembly 28.

A preferred description of this invention has been disclosed; however, a worker of ordinary skill in the art would recognize that certain modifications would come within the scope of this invention. For that reason, the following claims should be studied to determine the true scope and content of this invention.

We claim:

1. A cam follower assembly for an electric switch comprising:

a case having at least one wall with a slot, said one wall defining a housing;

a cam follower disposed in said housing and having a shaft movable within said slot; and a spring disposed in said housing adjacent said cam follower, said spring being separate from said cam follower, and said cam follower being movable relative to said spring, said spring biasing said cam follower toward a longitudinal axis of said housing, wherein said spring is generally C-shaped and has two arms, said arms operatively contacting, and applying a bias force to, opposite sides of said cam follower.

2. The cam follower assembly of claim 1, where said slot limits movement of said cam follower relative to said arms.

3. The cam follower assembly of claim 1, wherein there are two walls of said case having a living hinge therebetween.

4. The cam follower assembly of claim 3, wherein one of said walls has attachment elements which snap into a channel formed in the other of said walls.

5. The cam follower assembly of claim 1, wherein said slot is angled between about 0° and 30° from an axis taken perpendicular to said longitudinal axis.

6. The cam follower assembly of claim 1, wherein said spring is disposed in a plane perpendicular to said shaft.

7. A latching switch assembly comprising:

a switch button;

a cam assembly including a cam surface and at least one electrical connection arm, said cam surface having a heart-shaped configuration including a bottom tip, a left face, a trough and a right face;

a cam follower assembly including a case having at least one wall defining a housing, a cam follower disposed in said housing and having a shaft movable within said housing, a C-shaped spring disposed in said housing adjacent said cam follower, said spring being separate from said cam follower, and said cam follower being movable relative to said spring, said spring biasing said cam follower toward a longitudinal axis of said housing, said cam follower being limited in movement along said axis relative to said spring;

a latching switch body disposed between said cam assembly and said switch button and a plurality of switch button springs which bias said switch button away from said latching switch body; and wherein said trough and bottom tip correspond to on and off positions for said switch button, respectively, said switch button actuates said cam assembly to move said cam follower shaft along said cam surface, said shaft being received in a position with said at least one electrical connection arm in a position to operate an electrical switch, and wherein said cam surface is disposed in a plane parallel to said longitudinal axis, successive depressions of said switch button moves said cam follower shaft between positions adjacent said trough and bottom tip, and said shaft being received in said trough to prevent movement of said switch button due to said bias of said switch button springs.

8. The latching switch assembly of claim 7, wherein a slot is formed in said wall, said slot limiting movement of said cam follower relative to said spring.

9. The latching switch assembly of claim 8, wherein said slot is angled between about 0° and 30° from an axis taken perpendicular to said longitudinal axis.

10. The latching switch assembly of claim 7, wherein said C-shaped spring having two arms, one of said arms disposed adjacent either side of said cam follower.

11. The latching switch assembly of claim 7, wherein there are two walls of said case having a living hinge therebetween.

12. The latching switch assembly of claim 11, wherein a second of said walls has attachment elements which snap into a channel formed in said first of said walls.

13. The latching switch assembly of claim 7, wherein said spring is disposed in a plane perpendicular to said shaft.

14. A latching switch assembly comprising:

a switch button;

a cam assembly including a cam surface and at least one electrical connection arm, said cam surface having a heart-shaped configuration including a bottom tip, a left face, a trough and a right face, wherein said trough and bottom tip correspond to on and off positions for said switch button, respectively, and successive depressions of said switch button moves said cam follower shaft between positions adjacent said trough and bottom tip;

a latching switch body disposed between said cam assembly and said switch button and a plurality of switch button springs which bias said switch button away from said latching switch body;

a cam follower assembly including a case having at least one wall and defining a housing, and a slot in said one wall, a cam follower disposed in said housing and having a shaft movable within said slot, a spring disposed in said housing adjacent said cam follower, said spring being separate from said cam follower, and said cam follower movable relative to said spring, said spring biasing said cam follower toward a longitudinal axis of said housing, said cam follower being limited in movement along said axis relative to said spring; and wherein said switch button actuates said cam assembly to move said cam follower shaft along said cam surface, said shaft being received in a position of said cam surface to secure said cam assembly at a position with said at least one electrical connection arm in a predetermined position to operate an electrical switch.

15. The latching switch assembly of claim 14, wherein said spring being generally C-shaped and having two arms, one of said arms disposed adjacent either side of said cam follower.

16. The latching switch assembly of claim 15, wherein said slot limits movement of said cam follower relative to said arms.

17. The latching switch assembly of claim 14, wherein there are two walls of said case having a living hinge therebetween.

18. The latching switch assembly of claim 17, wherein a second of said walls has attachment elements which snap into a channel formed in a first of said walls.

19. The latching switch assembly of claim 14, wherein said spring is disposed in a plane perpendicular to said shaft.

20. A cam follower assembly for an electric switch comprising:

a case having two walls defining a housing, a slot in a first of said walls and a living hinge located between said walls;

a cam follower disposed in said housing and having a shaft movable within said slot; and a spring disposed in said housing adjacent said cam follower, said spring being separate from said cam follower, and said cam follower being movable relative to said spring, said spring biasing said cam follower toward a longitudinal axis of said housing.

21. A latching switch assembly comprising:

a switch button;

a cam assembly including a cam surface and at least one electrical connection arm;

a cam follower assembly including a case having two walls defining a housing and a living hinge disposed between said two walls, a cam follower disposed in said housing and having a shaft movable within said housing, a C-shaped spring disposed in said housing adjacent said cam follower, said spring being separate from said cam follower, and said cam follower being movable relative to said spring, said spring biasing said cam follower toward a longitudinal axis of said housing, said cam follower being limited in movement along said axis relative to said spring; and wherein said switch button actuates said cam assembly to move said cam follower shaft along said cam surface, said shaft being received in a position of said cam surface to secure said cam assembly at a position with said at least one electrical connection arm in a position to operate an electrical switch.

* * * * *